United States Patent [19]

Sugawara et al.

[11] Patent Number: 4,462,750

[45] Date of Patent: Jul. 31, 1984

[54] ELECTRIC FAN ASSEMBLY

[75] Inventors: Norio Sugawara; Motoyuki Nawa; Yutaka Takahashi, all of Nara, Japan

[73] Assignee: Matsushita Electric Industrial Co., Ltd., Osaka, Japan

[21] Appl. No.: 333,618

[22] Filed: Dec. 22, 1981

[30] Foreign Application Priority Data

Dec. 25, 1980 [JP] Japan ..... 55-186423
Feb. 2, 1981 [JP] Japan ..... 56-14794
Apr. 15, 1981 [JP] Japan ..... 56-57365

[51] Int. Cl.[3] ..... F04D 5/00
[52] U.S. Cl. ..... 415/54; 415/148
[58] Field of Search ..... 415/54, 148, 209, 216, 415/219 C

[56] References Cited

U.S. PATENT DOCUMENTS 3,080,824 3/1963 Boyd et al. ..... 415/54 UX
3,306,526 2/1967 Laing ..... 415/54
3,437,262 4/1969 Eck et al. ..... 415/54
3,441,201 4/1969 Hollenberg ..... 415/54 UX
3,477,635 11/1969 Glucksman et al. ..... 415/54
3,828,531 8/1974 Quick ..... 415/54 UX

FOREIGN PATENT DOCUMENTS 876611 6/1961 United Kingdom ..... 415/54

*Primary Examiner*—John W. Shepperd
*Assistant Examiner*—Joseph M. Pitko
*Attorney, Agent, or Firm*—Wenderoth, Lind & Ponack

[57] ABSTRACT

An electric fan assembly comprises a generally cylindrical cross-flow fan, a rear guider, and a stabilizer. The rear guider has a downstream edge with respect to the direction of flow of an air current and is hingedly connected with a pivotable plate. By the utilization of the adherence effect of the air current to the pivotable plate, the direction of flow of the air current is controlled by pivoting the pivotable plate. In other words a slight pivotal movement of the pivotable plate is sufficient to bring about the deflection of the air current over a relatively large angle. The fan assembly may be employed in an air-conditioner in which case a relatively high air-conditioning efficiency can be obtained.

5 Claims, 11 Drawing Figures

ELECTRIC FAN ASSEMBLY

BACKGROUND OF THE INVENTION

1. Field of the Invention

The present invention generally relates to an electic fan assembly capable of directing a current of air in any adjusted direction and, more particularly, to an electric fan assembly suited for use in an air-conditioner.

2. Description of the Prior Art

One prior art electric fan assembly which appears to be conceptually similar to the present invention is illustrated in FIGS. 1 and 2 of the accompanying drawings in perspective and endwise sectional views, respectively. Referring to FIGS. 1 and 2, the prior art electric fan assembly comprises a base plate 1 having a support leg 2 rigidly mounted thereon. A generally cylindrical motor casing 3 is rigidly mounted on the top of the support leg 2 with its longitudinal axis lying parallel to the base plate 1. Casing 3 houses therein an electric drive motor (not shown) having its drive shaft 6 extending outwardly from the motor casing 3 in parallel to the base plate. A power control switch 4 is installed on the motor casing 3 for selectively energizing and deenergizing the drive motor, as is well known to those skilled in the art. The fan assembly shown in FIGS. 1 and 2 also comprises a generally cylindrically cross-flow fan 5 mounted coaxially on the drive shaft 6 for rotation together therewith. A rear baffling plate 7 is so supported by the motor casing 3 and so shaped as to partially encircle the cross-flow fan 5 over an angular distance approximately corresponding to half the outer diameter of the cros-flow fan 5. A stabilizer bar 8 extends in parallel spaced relation to the cross-flow fan 5 for angular movement about the drive shaft 6 and is positioned on one side of the cross-flow fan 5 opposite to the baffling plate 7.

In the construction described with reference to FIGS. 1 and 2, the switching-on of the power control switch 4 results in rotation of the cross-flow fan 5 in one direction, for example, the clockwise direction about the drive shaft 6. As the fan 6 is so rotated, air is drawn towards the baffling plate 7 through a suction opening defined on the trailing side with respect to the direction of rotation of the fan 5 and is, after having been stirred to form a current of air, discharged in a predetermined direction through a discharge opening on the leading side with respect to the direction of rotation of the fan 5, substantially as shown by the arrow-headed chain lines in FIG. 2. During the flow of the air in the manner shown by the arrow-headed chain lines, a vortex of air is generated at a region, shown by the circle V in FIG. 2, between the fan 5 and the stabilizer bar 8, which vortex V moves relatively around the fan 5 together with the stabilizer bar 8 when the latter is angularly moved to adjust the direction of flow of the air current emerging from the fan assembly.

While the suction and discharge openings in the fan assembly of FIGS. 1 and 2 may be considered as defined between the leading edge of the baffling plate 7 and the stabilizer bar 8 and between the trailing edge of the baffling plate 7 and the stabilizer bar 8, respectively. The adjustment of the position of the stabilizer bar 8 relative to the fan 5 or the baffling plate 7 results in a change in width of the suction and discharge openings in opposite relation. Therefore, the pattern of distribution of the expelled air current varies with the position of the stabilizer bar 8, as readily may be understood from FIG. 2.

The prior art fan assembly of the construction shown in FIGS. 1 and 2 is satisfactory and effective in that the direction of flow of the expelled air current can be adjustable merely by angularly moving the stabilizer bar 8. However, it has been found that the velocity of flow of the expelled air current tends to vary with the adjusted direction of blow of the expelled air current, thereby posing some disadvantages and inconveniences. Thses disadvantages and inconveniences are pronounced specifically where the concept embodied by the construction shown in FIGS. 1 and 2 is employed in a domestic space heating and/or cooling device, particularly a domestic air-conditioner having a heat pump system, to make a forced draft of air available.

Specifically, while it is generally required that the expelled air current must reach as far as possible in order for a house room to be uniformly cooled or heated when the air-conditioner is operating in a cooling mode or a heating mode, respectively. The design and structure such as employed in the prior art fan assembly cannot achieve the above described requirement satisfactorily.

SUMMARY OF THE INVENTION

Accordingly, the present invention has been developed with a view to substantially eliminating the disadvantages and inconveniences which would manifest themselves when the prior art fan assembly is employed in a domestic heating and/or cooling device. The present invention has for its essential object to provide a fan assembly for use in the domestic heating and/or cooling device. It is compact in size and, therefore, requires minimal space for the installation thereof to attain the increased deflecting angle of flow of the expelled air current.

In order to accomplish this and other objects of the present invention, the present invention provides an electric fan assembly which comprises: a generally cylindrical cross-flow fan rotatable about a fan axle to produce a vortex of air thereby producing a flow of air current, a stabilizer, a rear guider having an upstream edge (with respect to the direction of flow of the air current) fixed relative to the fan axle, and a pivotable plate having an upstream edge hingedly connected to a downstream edge of the rear guider. The fan assembly in accordance with the present invention is so designed that, while the air current produced by the generation of the vortex adheres to and flows smoothly along the pivotable plate, the pivotal movement of the pivotable plate can result in the movement of the vortex. Therefore, a slight pivotal movement is sufficient to bring about the increased deflecting direction of flow of the air current emerging from the fan assembly.

Accordingly, when the fan assembly is employed in the air-conditioner, the space to be cooled or heated can be substantially uniformly be cooled or heated because velocity distribution of the flow of the air current is scarcely affected by the direction of flow of the air current. In addition, since the angle through which the pivotable plate is rotated may be small, the installation of the heat exchanger can readily be carried out.

The fan assembly according to the present invention may also comprise a flow control member positioned in a discharge region adjacent the fan so that the flow of the air current can be controlled without adversely affecting the rate of flow of the air current emerging therefrom even when the direction of flow of the air current is changed. If the flow control member is movably supported, the air current emerging from the fan assembly can be divided into two flow components, one directed towards a horizontal direction and the other directed downwards.

In view of the above, the present invention is, when applied to the design of an air-conditioner, such as to contribute to the manufacture of the air-conditioner, simple in structure, easy to operate, and effective to give a high air-conditioning efficiency.

BRIEF DESCRIPTION OF THE DRAWINGS

These and other objects and features of the present invention will become apparent from the following description taken in conjunction with preferred embodiments thereof with reference to the accompanying drawings, in which.

DETAILED DESCRIPTION OF THE PREFERRED EMBODIMENTS

Figure 1:
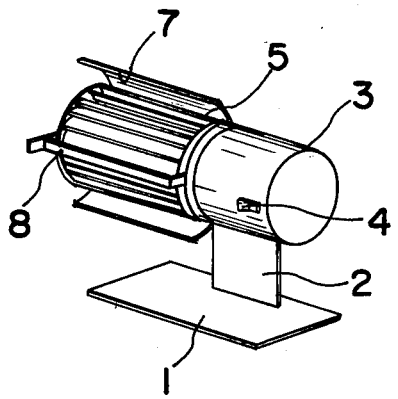
Fig. 1 Prior Art
FIG. 1 is a perspective view of the prior art fan assembly.
Figure 2:
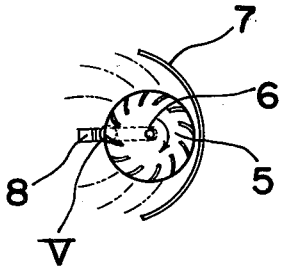
Fig. 2 Prior Art
FIG. 2 is an endwise sectional view of the cross-flow fan and its associated parts in the fan assembly of FIG. 1.

Before the description of the present invention proceeds, it is to be noted that like parts are designated by like reference numerals throughout FIGS. 3 to 11.

Figure 3:
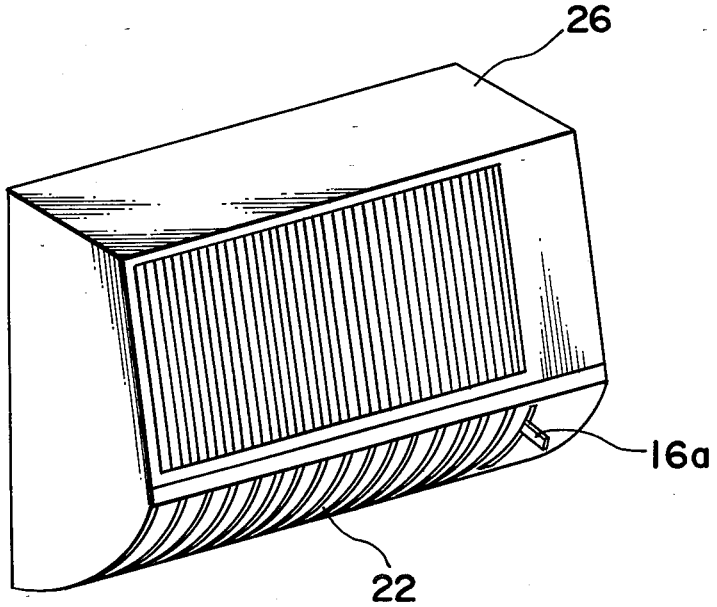
FIG. 3 is a perspective view of a wall-mounted indoor unit of a split system heat pump, embodying the present invention.
Figure 4:
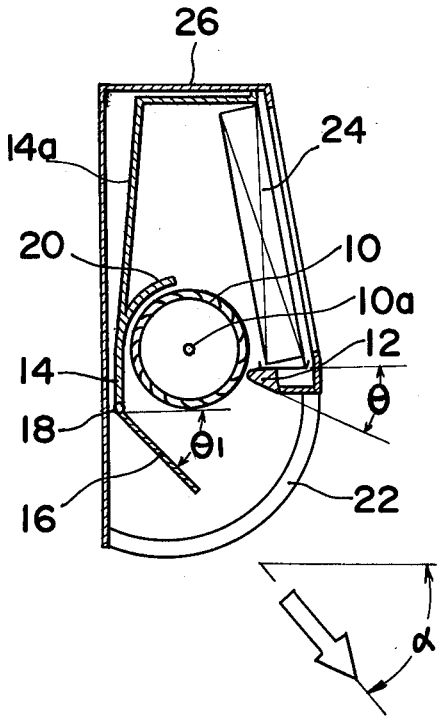
FIGS. 4 and 5 are endwise sectional views of the indoor unit of FIG. 3 with a pivotable plate shown in different operative positions.
Figure 5:
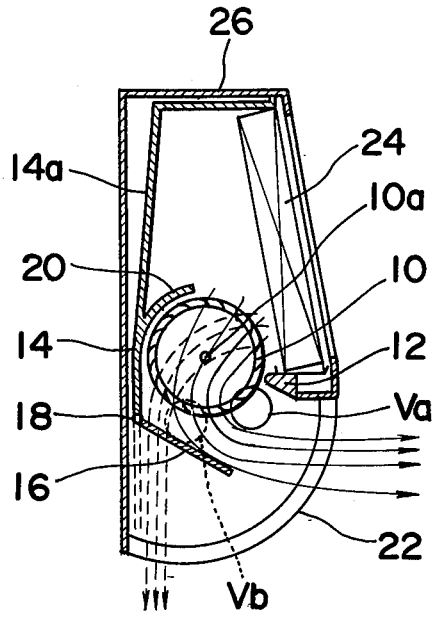
Figure 11:
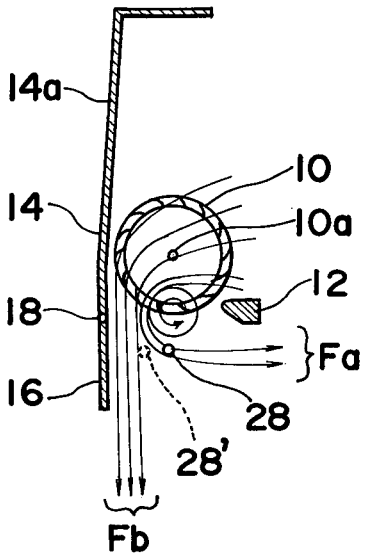
FIG. 11 is a view similar to FIG. 9, showing a further embodiment of the present invention.

Referring now to FIGS. 3 to 5, a fan assembly embodying the present invention comprises a generally cylindrical cross-flow fan 10 rotatable about a fan axle 10*a* and effective to produce a vortex V of air, thereby producing the flow of air current during the rotation thereof about the fan axle 10*a*, a stabilizer 12 on one side of the fan 10 for stabilizing the vortex V, a rear guider 14 being on the opposite side of the fan 10 and having an upstream edge portion 14*a* extending above the cross-flow fan 10, with respect to the direction of flow of the air current, and a pivotable plate 16 having its upstream edge hingedly connected at a hinge 18 to a downstream edge of the rear guider 14. As shown in FIGS. 4 and 5, the rear guider 14 has a construction extending in a straight line tangentially from a position extremely close to the circumference of the cross-flow fan 10, and the pivotable plate 16 is provided at the downstream side of the rear guider 14. Also, the stabilizer 12 and the single sheet of the pivotable plate 16 together constitute an air outlet. With this construction, an air current caused by the vortex Va may flow along the extended portion of the pivotable plate 16 shown in solid lines in FIG. 5. If the pivotable plate 16 is located at a position as shown in FIG. 11, the air current component Fb is directed along the extended downstream portion of the rear guider 14 and, at this time, the vortex V is also shifted closer to the rear guider 14 by the air current component Fa. If the pivotable plate 16 is rotated farther, the direction of the air current components Fa and Fb is likewise changed. The rear guider 14 has a regulating plate 20 for regulating the direction in which air is sucked and also for stabilizing the vortex V when the latter is moved, i.e., shifted in position. The stabilizer 12 has a relatively small wedge angle $\theta$, for the purpose of facilitating the shift in position of the vortex V. The smaller the wedge angle $\theta$, the more easily the shift in position of the vortex V can be accomplished. However, an excessively small wedge angle $\theta$ tends to result in a reduced volume of air flow.

A generally rectangular casing 26 for a wall-mounted indoor unit of a split system heat pump has a louver 22 for deflecting the air current in a lateral direction, i.e., selectively leftwards and rightwards and a heat exchanger 24 positioned on the upstream side of the fan assembly with respect to the direction of flow of air towards the fan 10. As shown in FIG. 3, the pivotable plate 16 has a manipulatable lever 16*a* extending therefrom and exposed to the outside of the casing 26 at a position laterally of the louver 22 so that, by moving the lever 16*a*, the position of the pivotable plate 16 relative to the fan 10 can be adjusted.

In the construction described above and shown in FIG. 5, the rotation of the cross-flow fan 10 is accompanied by the occurrence of the vortex Va at a region adjacent the stabilizer 12. As a result thereof, the air flows in a manner as shown by the arrow-headed solid lines in a substantially horizontal direction.

However, when the pivotable plate 16 is pivoted to a vertically downward position shown by the broken lines in FIG. 5, the air current shown by the arrow-headed broken lines and produced by the occurrence of the vortex adheres to the pivotable plate 16 and, at the same time, the vortex Va is shifted to a position shown by vortex Vb, with the air current flowing in a manner shown by the arrow-headed broken lines, that is, in a direction downwards. At this time, the regulating plate 20 may facilitate the stabilization of the vortex Vb by regulating the direction in which the air is sucked. However, this may not be always necessary.

Figure 6:
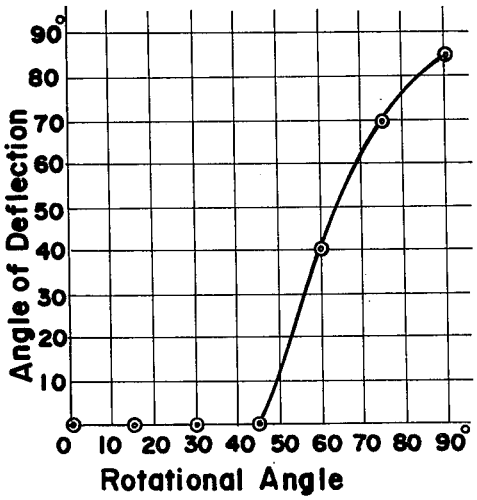
FIG. 6 is a graph showing the flow distribution characteristic of the fan assembly according to the present invention.

Thus, the position of the vortex varies according to the angle $\theta_1$ of the pivotable plate 16, as shown in FIG. 4 and, therefore, the angle of deflection $\alpha$ of the air current varies according to the angle $\theta_1$ of the pivotable plate 16. FIG. 6 illustrates the relationship between the rotational angle $\theta_1$ of the pivotable plate 16 and the angle $\alpha$ of deflection, and it will readily be seen that the deflection angle $\alpha$ of the air current starts increasing when the angle $\theta_1$ of rotation of the pivotable plate 16 is 45° and attains almost 90° when the angle $\theta_1$ of rotation of the pivotable plate 16 is also 90°. That is to say, the rotation of the pivotable plate 16 through the angle $\theta_1$ from 45° to 90° the results in deflection of the air current in an angle $\alpha$ of 90° which is about twice the change in the angle $\theta_1$. In view of this relationship, a slight movement of the manipulatable lever 16*a* is sufficient to bring about the deflection of the air current through the angle $\alpha$.

The pivotable plate 16 may be rotated by a motor for the purpose of achieving an automatic deflection. Even in this case, a quick control can be achieved because a relatively small angle $\theta_1$ of rotation of the pivotable plate 16 can give a relatively large angle of deflection $\alpha$. Moreover, since the control can be performed only by the rotation about the hinge 18, the design is simple and the casing 26 can have a reduced thickness.

Although the fan assembly of the construction shown particularly in FIGS. 4 and 5 is satisfactory, it may have a flow control member 28 for controlling the air current without adversely affecting the rate of flow thereof even when the direction of flow of the air current is changed. This will now be described with reference to FIGS. 7 to 9.

Figure 7:
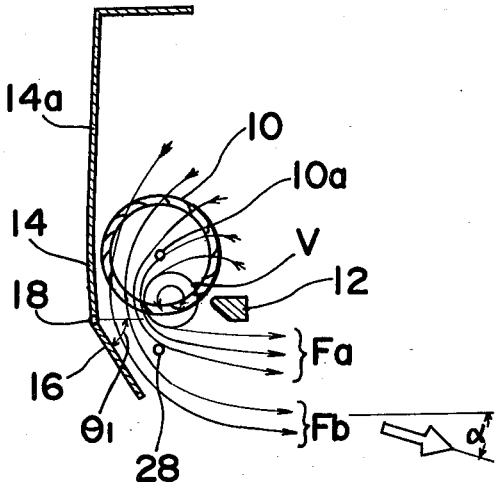
FIGS. 7 to 9 are views similar to any one of FIGS. 4 and 5, showing the fan assembly, with the pivotable plate in different operative positions, according to another preferred embodiment of the present invention.
Figure 8:
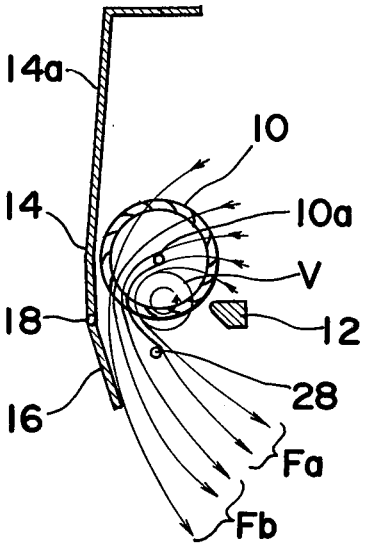
Figure 9:
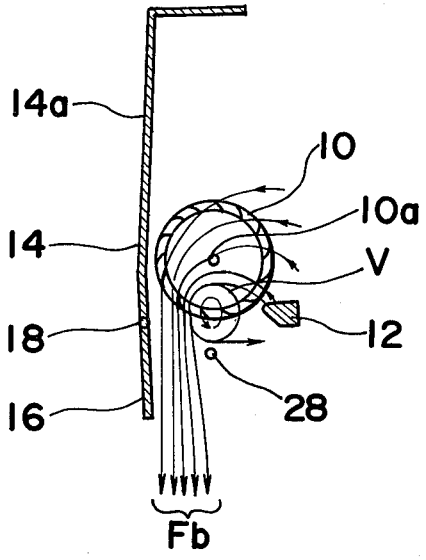

Referring to FIGS. 7 to 9, the flow control member 28 is positioned adjacent the fan 10 at a downstream side with respect to the direction of flow of the air current and between the stabilizer 12 and the pivotable plate 16. This flow control member 28 is operable to divide the air current, produced by the occurrence of the vortex V in the manner as hereinbefore described, into two flow components and to facilitate the adherence of one of the flow components, which flows smoothly adjacent the pivotable plate 16, to the pivotable plate 16, thereby shifting the position of the vortex V in a direction closer towards the pivotable plate 16.

The flow control member 28 so far shown is in the form of a cylindrical rod because of its simple construction and also because of the availability of its assured function, but it may be of any other suitable shape.

The operation of the fan assembly of the construction shown in FIGS. 7 to 9 will now be described.

Assuming that the pivotable plate 16 is so positioned that the rotational angle $\theta_1$ is not larger than about 60°, the air current produced by the occurrence of the vortex V in the manner as hereinbefore described in connection with the foregoing embodiment is divided into two current components Fa and Fb by the flow control member 28. The first current component Fa, flowing past a region between the flow control member 28 and the stabilizer 12, tends to travel in the horizontal direction by the action of the vortex V. However, since it is large as compared with the second current component Fb, flowing past a region between the flow control member 28 and the pivotable plate 16 (It is to be noted that this current component Fb is forced to adhere to the pivotable plate 16 by the action of the flow control member 28.), the direction of the deflection angle $\alpha$ of flow of the air current as a whole is parallel to the direction of first current component Fa, i.e., in the horizontal direction.

When the pivotable plate 16 is subsequently rotated with the angle $\theta_1$ gradually increasing as shown in FIG. 8, the vortex V shifts in position towards the pivotable plate 16 and, at the same time, the quantity of the air in the second current component Fb which adheres to the pivotable plate 16 increases gradually. As a consequence, the quantity of the air in the second current component Fb becomes of a value which cannot be neglected relative to the quantity of the air in the first current component Fa, and the two current components Fa and Fb interfere with each other, resulting in the air current as a whole flowing in the direction in which the two current components join together. The vortex V is, at this time, positioned at a region spaced from the stabilizer 12 a distance larger than that shown in FIG. 7 and is stabilized thereat by the action of the second current component Fb which has adhered to the pivotable plate 16 by the action of the flow control member 28.

When the pivotable plate 16 is so rotated that the angle $\theta_1$ becomes 90° as shown in FIG. 9, the current component Fb flowing in adherence to the pivotable plate 16 becomes the sole expelled air current emerging outwards from the rear guider 14 in a direction downwards after having been so deflected in such direction.

Figure 10:
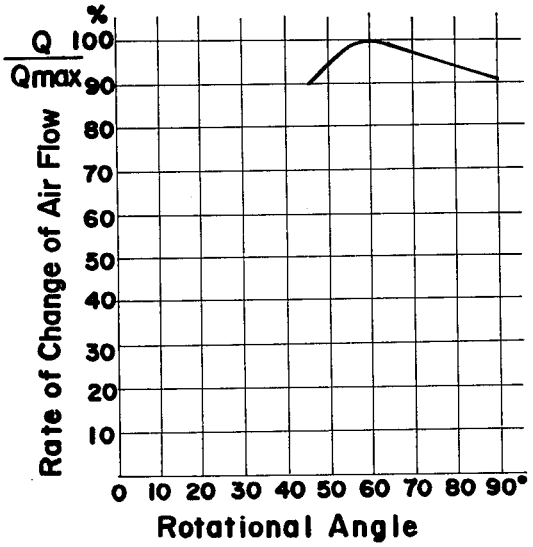
FIG. 10 is a graph showing the relationship between the position of the pivotable plate and the rate of change of the air flow according to the embodiment shown in FIGS. 7 and 9.

The relationship between the angle $\theta_1$ of rotation of the pivotable plate 16 and the angle $\alpha$ of deflection of the air current is similar to that shown in FIG. 6. The rate of change in air flow relative to the rate of change in angle $\theta_1$, which is exhibited by the fan assembly of the construction shown in FIGS. 7 to 9, is shown in FIG. 10. From the graph of FIG. 10, it is clear that, even when the pivotable plate 16 is tilted to the angle $\theta_1$ of 90°, the rate of change in air flow is not higher than 10% relative to the maximum volume of air flow which is attained when the angle $\theta_1$ is 60°. This suggests that one may consider no change in air flow being exhibited in the fan assembly according to the present invention. This advantage is derived from the utilization of both the shift in position of the vortex V and the action of the second air current Fb adhering to the pivotable plate 16 thereby deflecting the direction of flow of the combined air current Fa and Fb.

Where the present invention is applied to the wall-mounted indoor unit of the known split heat pump system, a relatively large amount of air current can be deflected merely by rotating the pivotable plate 16 without the flow volume being adversely affected as hereinbefore described. Therefore, it is possible to appreciate a surprising air-conditioning effect in that, during the heating, that is, when the air current is directed downwards, the air current can be deflected so as to flow in the downward direction without the flow volume being reduced. In addition, since the angle $\alpha$ of deflection of the air current is twice as large as or larger than the rotational angle $\theta_1$ of the pivotable plate 16 which can be obtained, the operation of the present invention is easy. Moreover, since the assembly of the present invention is simple in structure, the casing 26 can be designed in reduced thickness.

The flow control member 28 may be made movable and this will be described with reference to FIG. 11.

Where the air conditioner is so operated that a large volume of warmed air flows downwards, it has often occurred that one or more persons, when the warmed air impinges upon them feel uncomfortable. On the other hand, a series of experiments have shown that, in order to attain a feasible temperature distribution, it is desirable to cause a portion of the warmed air to flow downwards and also to cause the remaining portion of the warmed air to flow horizontally. In view of this result, in order to attain the feasible temperature distribution in the space to be air-conditioned and concurrently to remove the possibility that one or more persons may feel uncomfortable because of the direct impingement of the warmed air on them, a function of the present invention is to cause a poarion of the warmed air to flow downwards and also to cause the remaining portion of the warmed air to flow horizontally, that is a so-called dividing function has been required. This function can be attained merely by making the flow control member 28 in the fan assembly of FIGS. 7 to 9 movable as shown in FIG. 11.

Referring now to FIG. 11, if the flow control member 28 is moved to a new position shown by 28', the second current component Fb adhering to the pivotable plate 16 is reduced and that portion of the current component Fb which has been reduced joins together with the horizontally flowing current component Fa. In this way, the dividing function of causing a portion of the air current to flow downwards and causing the remaining portion of the air current to flow horizontally can be achieved. In this case, the volume of flow of the second downwardly flowing current component Fb can be adjusted at will merely by changing the position of the flow control member 28.

Although the present invention has been described in connection with the preferred embodiments thereof with reference to the accompanying drawings, it is to be noted that various changes and modifications are apparent to those skilled in the art. These changes and modifications are to be understood as included within the scope of the present invention.

What is claimed is:

1. An electric fan assembly comprising:

a generally cylindrical cross-flow fan rotatable about a fan axle to produce a vortex of air and a flow of air current, a stabilizer positioned at one side of the cross-flow fan, a rear guider being positioned at the opposite side of the cross-flow fan and having an upstream edge with respect to the direction of flow of the air current, and a single pivotable plate having an upstream edge connected to a hinge at a downstream edge of the rear guider in the vicinity of the vortex, said stabilizer and said single pivotable plate constituting an air outlet, said rear guider having a construction extending in a straight line tangentially both upstream and downstream from a position extremely close to the circumference of the cross-flow fan, said upstream edge of the rear guider extending substantially above the cross-flow fan, said air current, which has been produced by the occurrence of the vortex, smoothly flowing along the single pivotable plate, said single pivotable plate being rotatable from 45° to 90° so as to shift the vortex and to deflect the direction of the air current form 0° to almost 90°.

2. A fan assembly as claimed in claim 1, further comprising at least one flow control member positioned in a region adjacent said fan but outside said vortex and arranged between the stabilizer and the pivotable plate.

3. A fan assembly as claimed in claim 2, wherein said flow control member is movable.

4. A fan assembly as claimed in claim 2, wherein the flow control member is a cylindrical rod.

5. A fan assembly as claimed in claim 1, further comprising a regulating member positioned on an upstream side of the rear guider for regulating the direction in which the air is sucked.

* * * * *